US005460241A

United States Patent [19]

LaBelle

[11] Patent Number: 5,460,241

[45] Date of Patent: Oct. 24, 1995

[54] LADDER ACCESSARY

[76] Inventor: James R. LaBelle, 445 E. Breckenridge, Ferndale, Mich. 48220

[21] Appl. No.: 283,524

[22] Filed: Aug. 1, 1994

[51] Int. Cl.[6] ..... E06C 7/14

[52] U.S. Cl. ..... 182/214; 182/121

[58] Field of Search ..... 182/214, 229, 182/121, 122, 107; 248/238

[56] References Cited

U.S. PATENT DOCUMENTS

| | | | |
|---|---|---|---|
| 680,428 | 8/1901 | Carryl | 248/238 X |
| 1,118,385 | 11/1914 | Timmerman | 182/214 X |
| 3,454,132 | 7/1969 | Platino et al. | 182/121 |
| 3,568,801 | 3/1971 | Werner | 182/214 |
| 3,734,236 | 5/1973 | Houtler | 182/121 |
| 4,100,998 | 7/1978 | Marquez | 182/116 |
| 4,121,692 | 10/1978 | Morawski | 182/214 X |
| 4,194,592 | 3/1980 | Evans | 182/214 |
| 4,212,371 | 7/1980 | Gaviorno | 182/121 |
| 4,437,544 | 3/1984 | Anderson et al. | 182/120 |
| 4,862,994 | 9/1989 | Hughes, Sr. | 182/122 |
| 5,044,466 | 9/1991 | Jacobsmeyer, Jr. | 182/121 |
| 5,121,814 | 6/1992 | Southern | 182/214 |

FOREIGN PATENT DOCUMENTS

| | | | |
|---|---|---|---|
| 217052 | 5/1956 | Australia | 182/214 |

*Primary Examiner*—Alvin C. Chin-Shue

[57] ABSTRACT

A platform accessary for a ladder, including connectors for readily and securely mounting on two adjacent rungs of the ladder, by engaging the upper rung from above and engaging the next lower rung from below, with adjustment means for tightening the connectors thereon. The platform is adaptable to all rung shapes and sizes, and all types of "lean-to" ladder or extension ladders, and for mounting against either an outside corner or an inside corner of two adjacent walls. Additionally, the platform is foldable into a compact, substantially flat unit for storage and for carrying.

11 Claims, 2 Drawing Sheets

FIG. 1
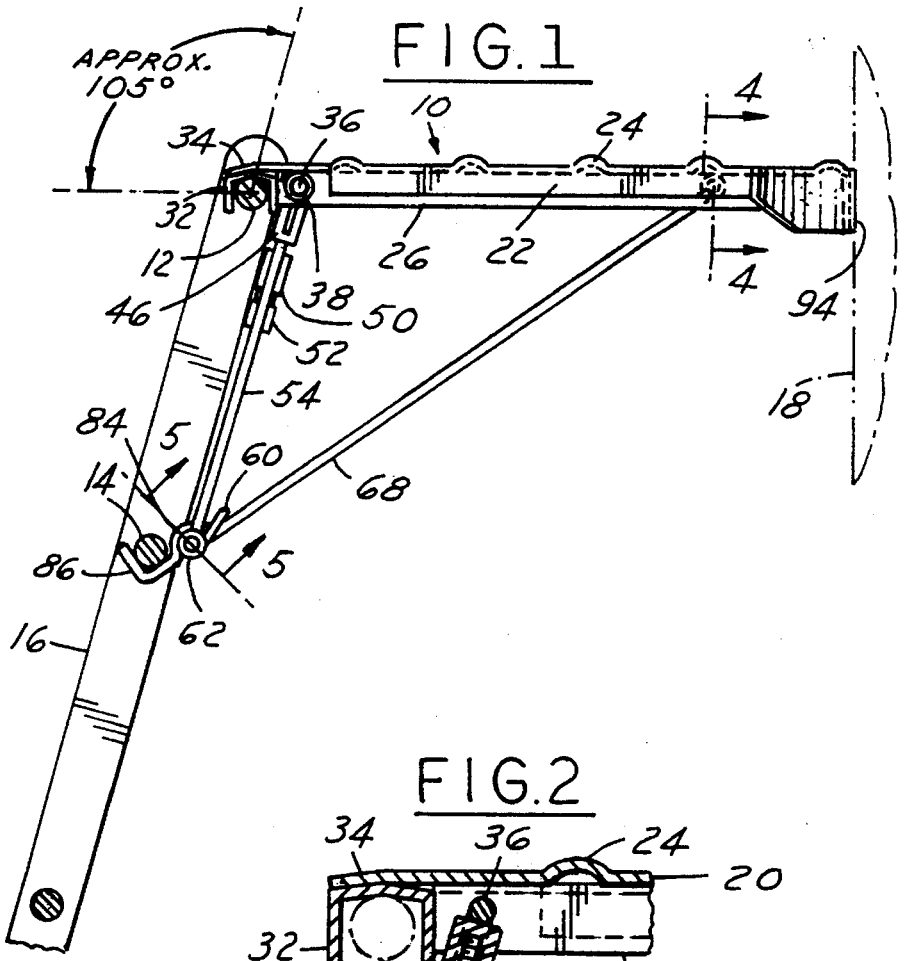
FIG. 2
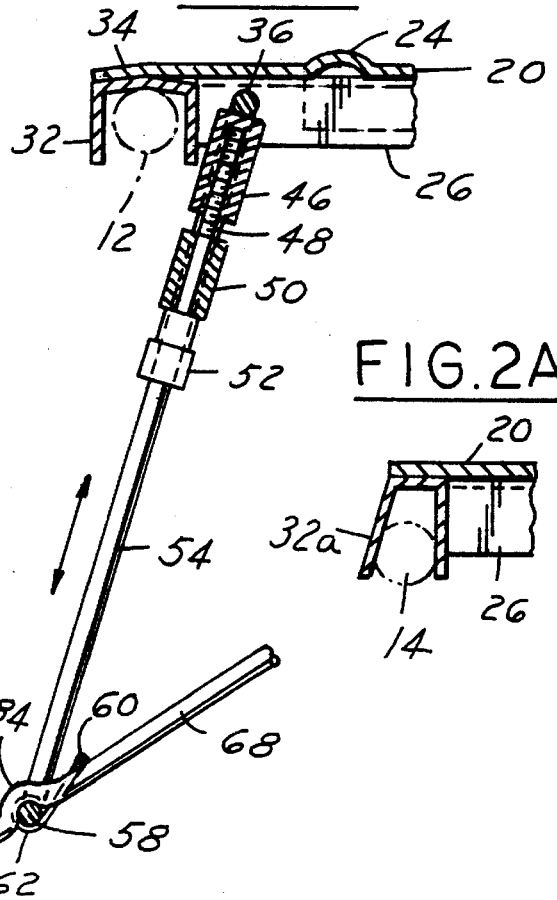
FIG. 3
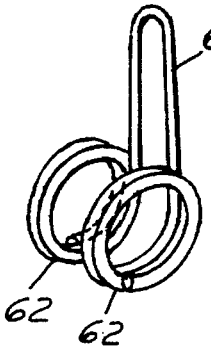
FIG. 2A

LADDER ACCESSARY

FIELD OF THE INVENTION

This invention relates generally to ladders and, more particularly, to a platform accessary for a ladder.

BACKGROUND ART

It is highly desirable to have a platform which readily and securely mounts on a lean-to ladder and serves, when level, to assure that the ladder leans against a wall at the preferred angle of 75° from horizontal, with the platform serving to support items such as cans of paint, tools, etc. It is also desirable to have such a platform which serves to mount against either outside or inside corners of two adjacent walls.

Heretofore, various ladder platforms or ladder stand-offs have been known, for example, Platino et al U.S. Pat. No. 3,454,132; Werner 3,568,801; Houtler 3,734,236; Marquez 4,100,998; Evans 4,194,592; Gaviorno 4,212,371; Anderson et al 4,437,544; Hughes 4,862,994; Jacobsmeyer 5,044,466; and Southern 5,121,814.

Of these ladder accessary designs, Platino et al includes spaced blocks and a shoe for ladder mounting on top of two adjacent ladder rungs; Werner includes brackets for mounting on top of two adjacent rungs, with a retainer pin extending across and beneath one of the rungs; Houtler discloses U-shaped ends on support braces for engaging two adjacent rungs, with pins extended therethrough to retain the rungs; Marquez includes clamps and support bolts for two adjacent rungs; Evans uses a pair of parallel braces between which a ladder is passed, with the braces bearing against opposite sides of the ladder; Gaviorno discloses hooks for mounting on an upper rung and hanger arms for lying against the next lower rung; Anderson et al disclose a pair of slots formed in extended arms for receiving a ladder rung, whereby rotation of the frame causes the slots to become misaligned to lock in the rung, with a backup support bar abuts against the front of the ladder side rails; Hughes discloses pivotally interconnected arms outside the oppositely disposed ladder side rails, with connector pins inserted therethrough into opposite ends of adjacent hollow metallic rungs; Jacobsmeyer includes spaced support arms long enough to extend downwardly past two adjacent rungs on opposite sides thereof, and Southern's stand off-brace mounts over the top rung only with adjustable legs extending therefrom for positioning the ladder on outside corner walls.

DISCLOSURE OF THE INVENTION

A general object of the invention is to provide an improved compact, light weight and efficient platform for mounting on an upper portion of any metal or wood ladder to support items such as cans of paint, tools, etc.

Another object of the invention is to provide a platform for a ladder, including connectors for readily and securely mounting on two adjacent rungs of the ladder, by engaging the upper rung from above and engaging the next lower rung from below, with adjustment means for tightening the connectors thereon.

A further object of the invention is to provide such a platform which is adaptable to all rung shapes and sizes, and all types of "lean-to" ladder or extension ladders.

Still another object of the invention is to provide a platform for a ladder, which is adaptable to mount against either an outside corner or an inside corner of two adjacent walls.

A still further object of the invention is to provide a platform which is foldable into a compact, substantially flat unit for storage and for carrying, and which is readily adaptable to being unfolded while being mounted on adjacent rungs of a ladder.

These and other objects and advantages will become more apparent when reference is made to the following drawings and the accompanying description.

BRIEF DESCRIPTION OF THE DRAWINGS

FIG. 1 is a side elevational view of the invention mounted on a ladder in position for mounting against a wall;

FIG. 2 is an enlarged cross-sectional view of a portion of the FIG. 1 structure;

FIG. 2A is a fragmentary view of an alternate embodiment of a portion of the FIG. 2 structure;

FIG. 3 is an enlarged perspective view of one component of the FIGS. 1 and 2 structure;

BEST MODE OF CARRYING OUT THE INVENTION

Figure 4:
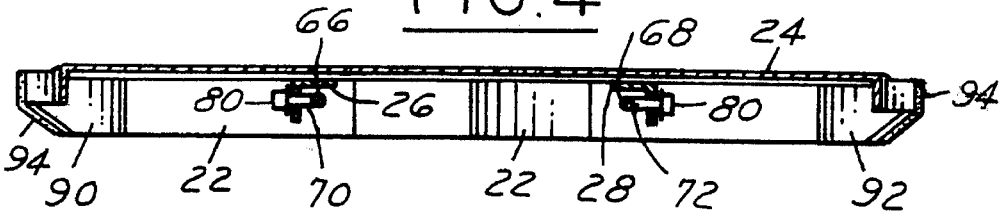
FIGS. 4 and 5 are cross-sectional views taken along the planes of the lines 4—4 and 5—5, respectively, of FIG. 1, and looking in the directions of the arrows.
Figure 5:
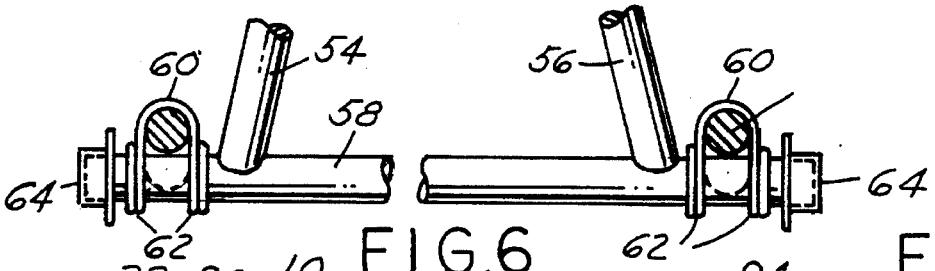

Referring now to the drawings in greater detail, FIG. 1 illustrates a platform assembly 10 mounted on rungs 12 and 14, which may be the top two rungs, or any selected lower two adjacent rungs, of a ladder 16 and abutted against a wall, represented as 18, to retain the ladder top away from the wall a predetermined distance. The platform assembly 10 includes a platform 20, which may be formed as an aluminum stamping, including a flanged outer edge 22, better seen in FIG. 6, a plurality of laterally oriented ridges 24 for retaining items, such as assorted tools, from falling or rolling off, and for supporting objects, such as cans of paint. The platform 20 is adapted to be mounted on the rungs 12 and 14, such that, when positioned level, i.e., horizontal against the wall 18, the ladder 16 is positioned on the ground surface at the known safest angle of 75° from horizontal.

A pair of spaced apart longitudinal right angle braces 26 and 28 (FIG. 6) are secured to the under side of the platform 20 in any suitable manner, such as by welding, and extend from the front edge 22 rearwardly through an opening 30 in the flange 22.

A transverse mounting bracket 32 is secured, as by welding, to the ends of the braces 26 and 28, and to an extended end portion 34 of the platform 20. The shallow-gable shape of the bracket 32 is such that it will seat on all known ladder rung sizes and shapes.

As shown in FIG. 2A, an alternate bracket 32*a* includes one vertical side wall, a flat end wall, and a diverging side wall for mounting on any size or shape rung.

A shaft 36 extends through aligned openings 38 and 40 formed in the respective braces 26 and 28 adjacent a side of the bracket 32. The shaft 36 is retained in place by end caps 42 press fitted on the ends thereof. A pair of symmetrical plates 44 (FIG. 6) are secured, as by welding, to the shaft 36, with a central internally threaded cylinder 46 secured to adjacent edges of the plates 44. A stud 48 having threads on the end thereof extends loosely through a sleeve 50 and threadedly into the threaded cylinder 46. A head 52 is formed on the outer end of the stud 48.

A pair of rods 54 and 56 are each welded at one end thereof to oppositely disposed sides of the sleeve 50, and extend in a diverging relationship to be welded at the other end thereof to a shaft 58. A connector formed as a U-shaped metal wire rod 60 (FIG. 3) has dual loops 62 formed at each end thereof for loosely mounting around each end portion of the shaft 58 outward of the rods 54 and 56. End caps 64 are press-fitted on the extreme ends of the shaft 58.

A pair of parallel rods 66 and 68 have respective bent ends 70 and 72 mounted through aligned openings 74 and 76 formed in the braces 26 and 28 adjacent a cross brace 78 welded between the braces 26 and 28. End caps 80 are press-fitted on the extended ends of each bent end 70 and 72. Aligned stops, such as depressions 82 and 84, are formed in the respective rods 66 and 68 adjacent the free ends thereof. In lieu of depressions 82 and 84, a pair of projections could be secured to the rods 66 and 68. A U-shaped cross bar 86 is formed between the free ends of the rods 66 and 68 serving as a rung bracket, as will be described.

Referring once again to FIG. 6, the flanged edge 22 of the platform 20 is shown to include a central V-shaped segment 88 and outer slanted corners 90 and 92. The sides of the segment 88 are approximately or slightly less than at a 90° relationship and the corners are formed at approximately a 45° degree relationship with the front edge of the platform 20. Such angles serve to accommodate an outside wall corner in the V segment 88, and an inside wall corner at the platform corners 90 and 92. A layer of suitable felt or rubber material 94 is adhered to the outer surfaces of the corners 90 and 92, the V segment 88, and the front end segments 94 and 96 between the respective corners and the V segment. The layer 94, of course, serves to prevent marring the surfaces of any walls which the layer mounts against, and also will prevent the platform from sliding laterally on slippery surfaces, such as vinyl siding.

Figure 6:
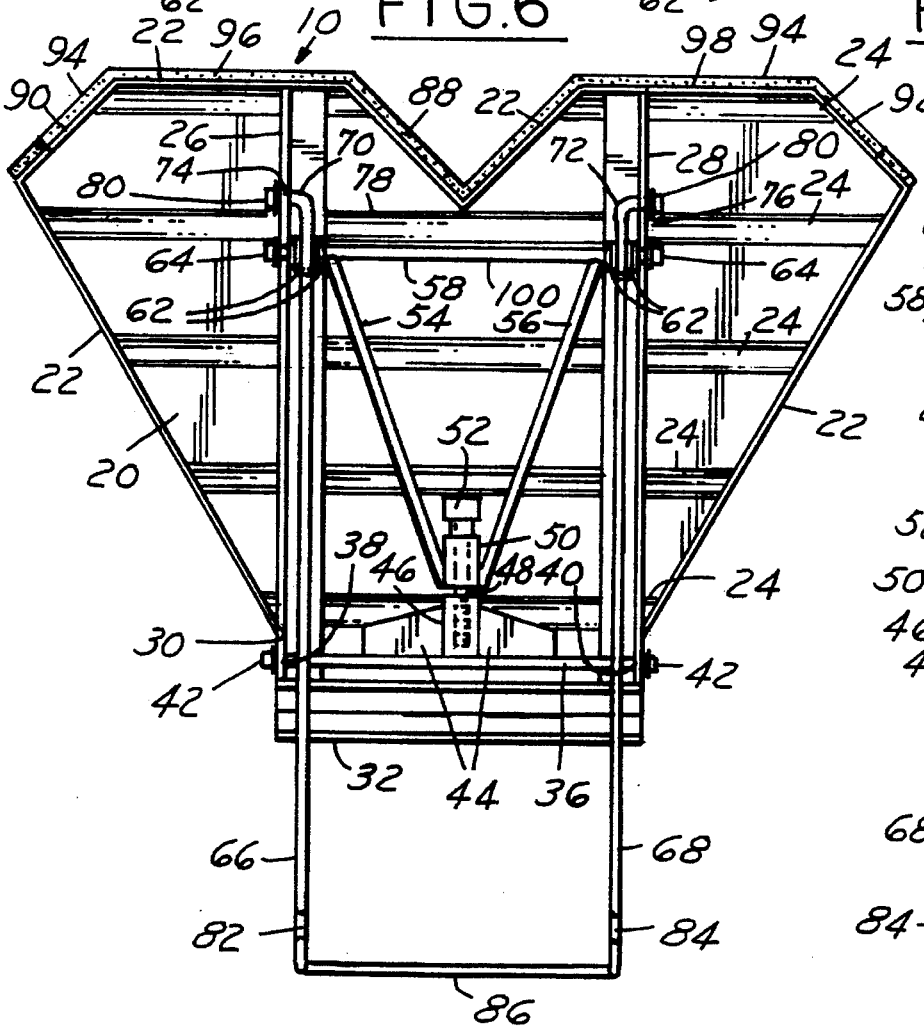
FIG. 6 is a bottom view of the invention in its closed condition for storing or carrying.
Figure 7:
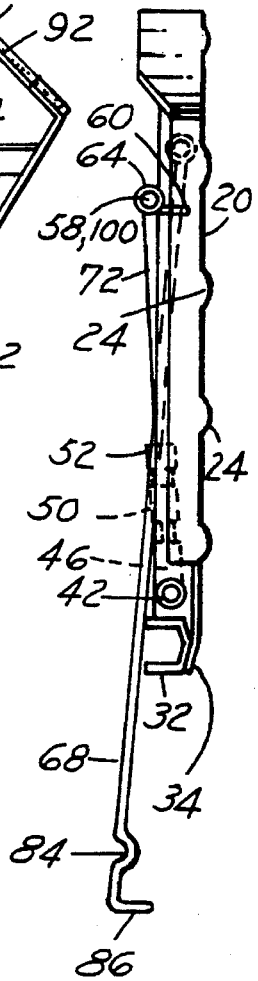
FIG. 7 is a side view of the FIG. 6 structure in its closed condition.

As may be noted from FIGS. 6 and 7, the shaft 58 serves, additionally, as a handle 100 by which the platform assembly 10 may be easily hand carried when not in use.

For assembly, a ladder 16 is first laid on the ground or other flat surface with the back side thereof facing up; the platform assembly 10 is placed upside down on the same surface adjacent the selected rung 12 of the ladder; the rods 66 and 68 are lifted enough to place the bracket 32 or **32*a* under the top rung 12; the platform 20 is then lifted, pivoting the bracket about the rung 12; once the platform 20 is approximately perpendicular to the ground and the U-shaped cross rod is beyond the second rung 14, the rod 58, identified as the carrying handle 100, is then lifted; this action moves the U-shaped wire rods 60 along the parallel rods 66 and 68, progressively drawing the U-shaped cross bar 86 toward the next lower rung 14 until it abuts thereagainst until the rod 58 segments between the loops 62 are seated in the depressions 82 and 84; the stud 48 is then threadedly tightened into the internally threaded cylinder 46, as required by different rung sizes and shapes, by manually turning the head 52, until the bracket 32 and 32*a* and the U-shaped bar 86 are tightly mounted on the respective rungs 12 and 14. The assembly on the ladder is now complete and the ladder can be uprighted and placed against the selected wall 18**.

Industrial Applicability

It should be apparent that the invention provides an improved, compact, easily carried and stored, lightweight, and highly efficient ladder platform for supporting items, such as paint cans and tools. The platform cannot be jostled loose from the ladder once it is assembled thereon by virtue of being tightly secured against the upper surface of the upper selected rung and against the bottom surface of the next lower rung.

It should be further apparent that the invention provides additional width for adding stability to any ladder used thereon.

While but one general embodiment has been shown and described, other modifications thereof are possible within the scope of the following claims.

What is claimed is:

1. For mounting on two selected rungs of a ladder, a platform assembly having a platform with an end for abutting against a wall, said assembly comprising a first bracket secured to an end portion of said platform opposite said abutting end for mounting on the upper surface of an upper selected rung, and a second bracket pivotally connected to said platform for mounting on the under side of the next lower rung, and single adjustment means operatively connected between said second bracket and said platform for tightening said first and second brackets against said selected upper and lower rungs to compensate for different rung sizes and/or shapes on different ladder designs, wherein said single adjustment means includes a cylinder operatively connected to the center portion of said second bracket, a stud threadedly connected in said cylinder, a sleeve loosely mounted around said stud, connector rods, each secured at one end thereof to said sleeve and operatively connected at the other end thereof to said platform.

2. The platform assembly described in claim 1, and stop means operatively connected to said second bracket for retaining said second bracket adjacent said lower rung.

3. The platform assembly described in claim 1, wherein said platform has right angled ends for mounting against the inside corner of two adjacent walls.

4. The platform assembly described in claim 1, wherein said platform has a V-shaped segment formed in said end thereof for mounting against the outside corner of two adjacent walls.

5. The platform assembly described in claim 1, wherein said second bracket is adapted to be pivotally flattened against said platform for storage.

6. For mounting on two selected rungs of a ladder, a platform assembly having a platform with an end for abutting against a wall, said assembly comprising a first bracket secured to an end portion of said platform opposite said abutting end for mounting on the upper surface of an upper selected rung, and a second bracket pivotally connected to said platform for mounting on the under side of the next lower rung, a pair of parallel rods each pivotally connected at one end thereof to said platform, said second bracket being secured between the distal ends of said pair of parallel rods, a first shaft pivotally connected to said platform, a pair of diverging rods each operatively connected at one end thereof to said first shaft and diverging toward said pair of parallel rods, a second shaft secured between the distal ends of said diverging rods, and a connector between the oppositely disposed ends of said second shaft and slidably mounted around each respective parallel rod, adapted to pivot said parallel rods and said second bracket upon the manual lifting of said second shaft to thereby urge said second bracket toward said lower rung.

7. The platform assembly described in claim 6, wherein said second bracket is a U-shaped bar connected at its ends to said pair of parallel rods.

8. The platform assembly described in claim 6, wherein said stop means includes stops formed on said respective parallel rods adjacent said second bracket adapted to be engaged by said respective connectors.

9. The platform assembly described in claim 8, wherein said connectors are each formed as a U-shaped wire rod slidably mounted around each of said pair of parallel rods, and including looped ends mounted around an end portion of said second shaft.

10. The platform assembly described in claim 6, wherein said adjustment means includes an internally threaded cylinder secured to said shaft, a stud having threads formed on an end thereof threadedly connected to said internally threaded cylinder, a sleeve loosely mounted around said stud, said one end of each of said pair of diverging rods secured to said sleeve, and a head on said free end of said stud for manually turning said stud.

11. The platform assembly described in claim 6, wherein said second shaft serves as a carrying handle when said assembly is folded flat and not mounted on a ladder.

* * * * *